US006120838A

United States Patent [19]

Zickell

[11] Patent Number: 6,120,838

[45] Date of Patent: Sep. 19, 2000

[54] METHOD OF MANUFACTURING ROOFING MATERIALS UTILIZING RECLAIMED ASPHALT-BASED MATERIALS

[76] Inventor: Thomas J. Zickell, 107 Tidewater Farms Rd., Stratham, N.H. 03885

[21] Appl. No.: 09/059,970

[22] Filed: Apr. 14, 1998

[51] Int. Cl.[7] ..... B05D 1/12

[52] U.S. Cl. ..... 427/186; 427/188; 427/202; 427/407.3

[58] Field of Search ..... 427/186, 187, 427/188, 196, 202, 204, 402, 407.3; 428/143, 144, 147

[56] References Cited

U.S. PATENT DOCUMENTS 4,726,846 2/1988 Jackson .

*Primary Examiner*—Fred J. Parker
*Attorney, Agent, or Firm*—Bourque & Associates, P.A.

[57] ABSTRACT

A recycled asphalt roofing material for use on sloped roofs, which provides the required elevated melt point without using prior art methods of oxidizing the asphalt prior to incorporation into the roofing material is provided. The recycled asphalt roofing material is made up of approximately 30% flux asphalt and approximately 70% reclaimed asphalt roofing material. The fibrous backing in the reclaimed material modifies the asphalt in such a way as to provide the required elevated melt point. The manufacturing process for recycled fiberglass mat-based roll and shingle roofing, in its preferred embodiment, consists of impregnating a roofing material backbone, such as a fiberglass or polyester mat with recycled asphalt material to form inner and outer layers of recycled material and then applying optional second inner and outer layers of standard asphalt coating to the inner and outer layers of the recycled material. The second coating encapsulates and seals the recycled material and thus ensures that the recycled roofing material will have the same longevity as prior art asphalt roofing materials.

20 Claims, 3 Drawing Sheets

METHOD OF MANUFACTURING ROOFING MATERIALS UTILIZING RECLAIMED ASPHALT-BASED MATERIALS

FIELD OF THE INVENTION

This invention relates to a recycled roofing material and method of manufacturing the same and in particular, to a roofing material which includes the addition of cellulose fiber, which is obtained from groundup, reclaimed roofing materials to asphalt roofing materials.

BACKGROUND OF THE INVENTION

Considerable waste is involved with the manufacturing and use of asphalt roofing materials, such as shingles and rolled roofing membranes. For example, each new shingle has cut out tabs that are removed and discarded. Old shingle material removed from old buildings also provides a significant amount of roofing material waste.

Waste generated from roofing materials, such as asphalt shingles, presents a significant environmental concern because of the composition of the roofing material. Typical shingles are composed of a cellulose and/or fiberglass fiber mat, a saturating asphalt within the mat, an asphalt coating on the asphalt saturated mat and granules disposed on the coating. Such materials are difficult to break down and have typically required complex recycling processes.

One asphalt shingle recycling process is disclosed in U.S. patent application Ser. No. 08/756,881 (U.S. Pat. No. 5,848,755) which is commonly owned by the assignee of the present invention and is fully incorporated herein by reference. The recycling system disclosed in the referenced patent application is capable of recycling asphalt roofing material and reducing granules, cellulose and fiberglass fibers and other particles in the asphalt roofing material to a fine mesh that can be maintained in suspension in liquid asphalt for later reuse.

Almost all roofing products that are used on sloped roofs use oxidized asphalt. Oxidized asphalt is asphalt that has been polymerized to increase its melt point. The oxidation/polymerization process increases the melt from approximately 100° F. (Fahrenheit) to over 200° F. In prior art asphalt roofing manufacturing processes, asphalt is oxidized by blowing high pressurized air into a tank of asphalt heated to approximately 400° F. An exothermic reaction occurs, which polymerizes the asphalt. The lighter fractions of the asphalt are driven off as a byproduct of the reaction. This process, however, is very expensive because of the energy costs associated with heating the asphalt to the required polymerization temperature and the costs associated with pollution control devices and methods.

Nonetheless, for roofing material utilized on sloped roofs, the polymerization process to date, has been required to prevent asphalt from melting and running off of a sloped roof once the melt point of non-oxidized asphalt is exceeded.

Although the oxidization process does increase the melt point of asphalt, which is required for sloped roofing materials, the oxidation process does have it drawbacks. One significant drawback of the oxidation process is that oxidation reduces the life of asphalt.

Asphalt is made up of three chemical groups, aromatics, saturates and asphaltenes. As asphalt oxidizes, its chemical composition changes. The oxidation process changes the aromatics, which are light oils, into asphaltenes, which are fine particles. Thus, oxidation makes asphalt roofing materials brittle.

Further oxidation occurs as asphalt roofing materials naturally age on a roof. This makes the roofing material even more brittle, which reduces the adhesive properties of the material so that the granules can fall off. The roofing material is also more susceptible to cracking. Asphalt that is oxidized during the manufacturing process is pre-aged, because the aromatics are driven off, thus reducing the life span of roofing material before the material is even installed on a roof.

The disclosed recycled roofing material and method of manufacturing the same overcomes many of the drawbacks associated with current roofing materials by the addition of cellulose or glass fiber to the asphalt material, which provides a material with the desired elevated melt point without requiring the oxidation process.

SUMMARY OF THE INVENTION

Accordingly, the present invention provides a recycled asphalt roofing material for use on sloped roofs, which provides the required elevated melt point of over 200° F. without using prior art methods of oxidizing the asphalt prior to its incorporation into the roofing material. This is accomplished by adding approximately 30% flux asphalt to approximately 70% reclaimed roofing materials. The approximately 30% asphalt flux reduces the viscosity of the asphalt material to a pumpable, flowable level. Although the flux is a non-oxidized asphalt with a melt point of approximately 100° F., the cellulose fiber included in the composite material modifies the asphalt in such a way as to allow raw flux asphalt to be used and still provides the desired elevated melt point. The flux also reconstitutes the asphalt since it contains the aromatic ingredients that were removed during the original oxidation process of the reclaimed roofing material and through the on-roof oxidation that occurred during the reclaimed roofing material's lifetime.

The process for manufacturing recycled fiberglass mat-based roll and shingle roofing, in its preferred embodiment, comprises impregnating a roofing material backbone, such as a fiberglass mat, with the disclosed, recycled roofing material. The impregnated mat may then be coated with an outer coat of standard asphalt coating on both sides of the recycled material. The second coating encapsulates and seals the recycled material and thus ensures that the recycled roofing material would have the same longevity as prior art asphalt roofing materials.

Recycled asphalt materials can also be used in the manufacture of other asphalt-based products, such as roofing cements, coatings and adhesives and ice and water shield products, each of which will exhibit improved performance characteristics over prior art products and will provide significant cost savings in their manufacture.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

A square of organic shingles weighs approximately 235 lb. The base of the shingle product is a cellulose fiber or sheet paper mat, which is saturated with asphalt. The cellulose fiber material weighs 27 lb. or 12% of the total shingle square weight. In addition, each square of shingles contains a number of mineral particles, including approximately 13% 10 mesh surfacing granules, 13% 200 mesh crushed limestone filler, and 3% 100 mesh sand.

A square of fiberglass shingles weighs substantially the same and has substantially the same construction. However, instead of including a cellulose fiber or sheet paper mat, the fiberglass shingle uses a fiberglass mat as its "backbone". The fiberglass mat weighs approximately 4–5 lbs., which represents approximately 5% of the total weight of a square of fiberglass shingles.

Figure 1:
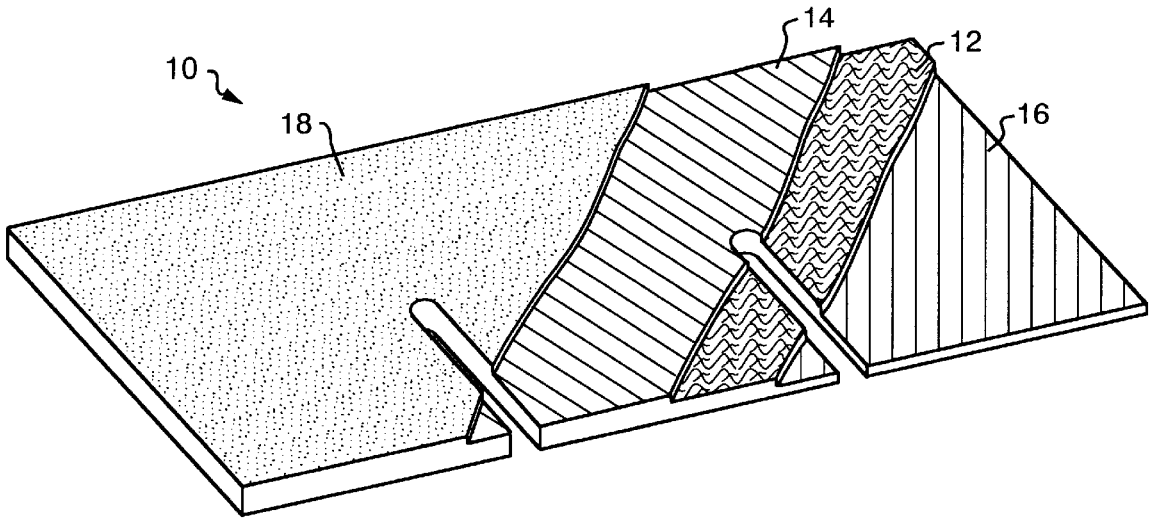
FIG. 1 (PRIOR ART)
FIG. 1 is a partial cut-away view of a typical prior art sloped roof shingle, showing the various layers of material included therein.

A prior art shingle is shown in FIG. 1 and is generally designated 10. The shingle includes backbone 12, which, may be an asphalt-saturated cellulose fiber, sheet paper or fiberglass mat. The saturated backbone is coated on its inner and outer sides with oxidized asphalt. The oxidized asphalt coating thus surrounds the backbone with inner and outer asphalt layers, 14 and 16 respectively. On the outer layer of asphalt coating, which is the side of the shingle that will be exposed to the environment, granules 18 are applied, which are typically colored to provide the desired look of the shingle or roofing material. These prior art shingles provide the major component of the recycled roofing material disclosed herein. In addition to shingles, rolled roofing is manufactured using a similar process and has an almost identical construction.

These asphalt roofing materials are reclaimed using an asphalt material recycling system and method, such as the one disclosed in commonly-owned U.S. patent application Ser. No. 08/756,881. Such a recycling system is used to reclaim asphalt material such as asphalt shingles and rolled roofing in a liquefied form, which can be stored and used as a component of the recycled roofing material disclosed herein. The recycling system shreds individual cellulose fibers found in the asphalt shingles and rolled roofing material recycled in the system. This is accomplished using, for example, a ball mill, which shreds the individual fibers. The recycling system also reduces the size of the mineral particles to substantially within the range of 250 to 300 mesh.

The recycled roofing material comprises ground up asphalt shingles comprising substantially between 5 and 20 percent by weight fiber material.

According to the present invention, the reclaimed asphalt roofing material, which constitutes approximately 12% cellulose fiber, 5% fiberglass fiber or some combination thereof, depending upon the composition of the reclaimed roofing material, is mixed with other, non-oxidized asphalt, such as flux asphalt and is a key ingredient of the recycled roofing material disclosed herein. Substantially between 50% and 80% reclaimed roofing material is mixed with substantially between 20% and 50%, by weight, non-oxidized asphalt, such as flux asphalt. In the preferred embodiment, approximately 70% reclaimed roofing material is mixed with approximately 30% other asphalt, such as flux asphalt. The addition of flux asphalt reduces the viscosity of the composite, recycled roofing material to a pumpable, flowable level.

The flux asphalt is a non-oxidized asphalt with a melt point of approximately 100° F. However, once the non-oxidized flux asphalt is included with the reclaimed, roofing material, the cellulose or fiberglass fiber in the reclaimed, roofing material, coupled with the milled mineral particles, modifies the flux and saturating asphalt to increase the effective melt point to over 200° F.

Unlike the oxidation process, the current invention does not modify the actual melting point of the asphalt by modifying its chemical composition. Instead, the effective melting point is modified due to the mechanical interaction of the various components included in the recycled asphalt material. The elevated effective melting point is primarily due to the increased viscosity of the recycled roofing material that is attributable to the addition of the cellulose fiber. The increased viscosity is related to the surface friction of the liquid asphalt flowing over the fibers. In addition, the reduced particle size of the mineral particles found in the recycled material increase the effective surface area that comes in contact with the liquid asphalt, which also increases the viscosity of the composite material and reduces its tendency to flow.

This is comparable to the melt point increase achieved through prior art asphalt oxidation processes. However, the present invention does not require that the asphalt mixture be heated to 400° F. in order to oxidize and polymerize the asphalt, for the addition of the fiber to the material increases the melt point and reduces the flow characteristics of the asphalt.

In addition, since the polymerization reaction is not required, the lighter fractions of the asphalt are not driven off. Thus, the expensive pollution control apparatuses used to filter these fractions are not required. Accordingly, the process reduces the energy costs associated with manufacturing asphalt material to be included on shingles as well as eliminates the pollution control apparatuses required for prior art asphalt polymerization.

Figure 2:
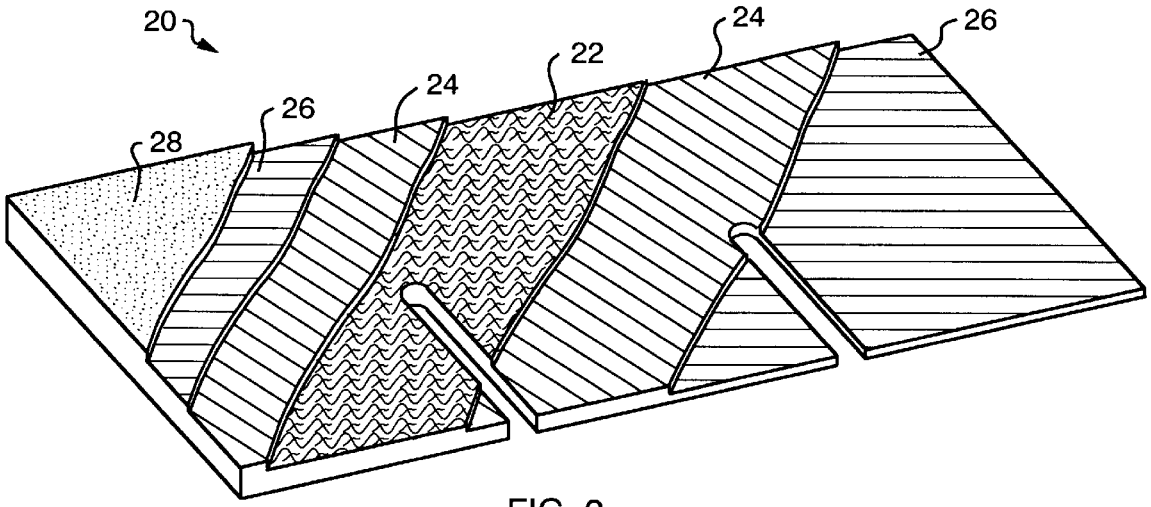
FIG. 2 is a partial cut-away view of a recycled sloped roof shingle manufactured in accordance with the teachings of the present invention.

FIG. 2 shows a shingle manufactured using the recycled asphalt material as disclosed herein, which is generally designated 20. Asphalt shingle 20, like prior art asphalt shingles includes a "backbone" 22. Backbone 22, which is preferably made of fiberglass or polyester mat, serves as the base of the shingle structure. Backbone 22 is saturated within and on both sides with the recycled asphalt material discussed above. This forms inner and outer layers of recycled asphalt material 24.

In one embodiment of the invention, in order to fully encapsulate the recycled asphalt material, second, inner and outer layers of standard, polymerized asphalt coating 26 are applied to both the inner and outer layers of recycled material 24. While the second inner and outer layers of standard, polymerized asphalt coating are not mandatory, they reduce the possibility that the fibers included within the recycled asphalt material could wick moisture into the roofing material structure, which could lead to premature roofing material failure.

Figure 3:
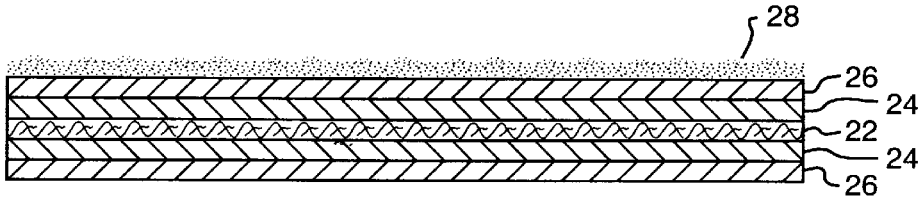
FIG. 3 is a cross section of a recycled shingle manufactured in accordance with the teachings of the present invention.

Finally, as with prior art shingles and roll roofing materials, granules or particles 28 are applied to the outer layer of the shingle, which may be the outer layer of recycled material or the outer layer of oxidized asphalt material, to add color and/or texture to the shingle. The cross-section of the shingle of FIG. 2 is shown in FIG. 3.

Figure 4:
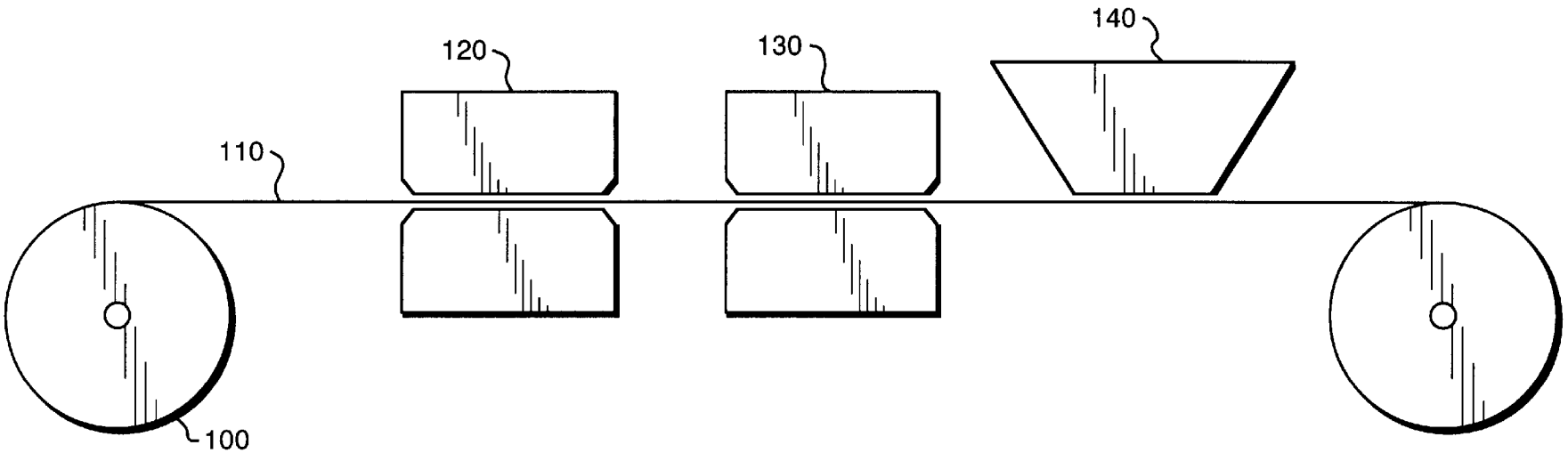
FIG. 4 is a side view of a production line configured to manufacture recycled roofing materials in accordance with the teachings of the present invention.

FIG. 4 discloses a process of manufacturing asphalt shingles and/or rolled roofing using the principles of the present invention. First, the roofing material backbone 22, which is preferably a fiberglass or polyester mat is provided on a roll 100. The roofing material backbone 22 is then drawn off of roll 100 and through a first coater 110 which applies the recycled asphalt material disclosed herein within and to both sides of the backbone 22. The motive force for drawing the backbone through the manufactured process may be any well known means of drawing a roll-type material through a production line coater.

The first coater 110 is a standard two roll roofing material coating apparatus. Once the saturated and coated backbone exits the first coater 110, where it has been coated on both sides with the recycled roofing material, the coated backbone is drawn through an optional second coater 120, where an optional second layer of asphalt material is applied on top of the recycled material. Like first coater 110, the second coater 120 is also a standard two roll roofing material coating apparatus.

The optional second asphalt layer is a standard, prior art oxidized asphalt material. The second asphalt layer thus encapsulates the recycled material so as to minimize any wicking effect caused by the inclusion of fibers in the recycled asphalt material. By using oxidized asphalt outer layers, roofing materials made in accordance with the teachings of the present invention will have the same longevity as current shingle and roll roofing materials. However, the roofing materials manufactured as taught herein are stronger and stiffer than prior art roofing materials due to the addition of fibrous materials in the recycled asphalt. These are very desirable characteristics.

Once the roofing material has the second layer of asphalt applied thereon, the material passes through a particulate deposition system 130, where granules or particles are applied to the surface of the roofing material that will be exposed to the environment. The completed roofing material is then rolled onto a take up roll 140.

This material can then be used as is as roll roofing or can be further processed using conventional cutting machines and methods in order to create traditional roof shingles.

In addition to manufacturing shingles and roll roofing using the disclosed recycled asphalt material, as discussed above, the recycled asphalt material can be especially useful in the manufacture of asphalt-based roofing cements, coatings and adhesives. These materials are produced from the same ingredients as organic shingles, i.e. cellulose fiber, asphalt and mineral particle fillers. Mineral spirits are used as a thinner to make the materials workable with a trowel or brush.

The purpose of the fiber is to reinforce the product and to resist flow and creep. The intense shredding of the cellulose fiber and the fine grinding of the mineral particle components greatly reduces flow and makes the materials very smooth to apply.

Many asphalt cement and coating manufacturers use asbestos fibers rather than cellulose because the irregular diameter and shape of asbestos fibers makes for a superior product. However, by using reclaimed roofing materials, which have been processed through the recycling system discussed above, results in cellulose fibers that have been shredded into irregular shapes and sizes, which behaves in substantially the same manner as asbestos fibers. However, these products would not have any of the safety concerns that are associated with asbestos-based products.

Figure 5:
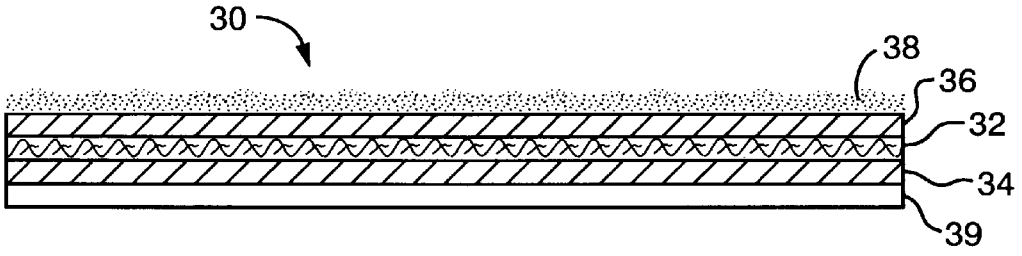
FIG. 5 (PRIOR ART)
FIG. 5 is a cross sectional view of a prior art ice and water shield product.

Self adhesive ice and water protection products 30 (FIG. 5) can also be manufactured using recycled roofing products. This family of products keeps water out of a house by adhering to the roof deck and sealing nail holes and the like. The standard configuration for an ice and water shield product is shown in FIG. 5 and includes a fiberglass mat 32 that is impregnated with rubberized asphalt, which forms inner and outer layers of rubberized asphalt 34 and 36. The outer layer 36 of the asphalt impregnated mat is then coated with granules 38 and a release sheet 39 is applied to the inner layer 34. When the shield is applied to a roof deck, the release sheet 39 is removed, allowing the inner layer of adhesive, rubberized asphalt 34 to stick to the roof deck.

However, by utilizing recycled roofing materials in a double coating configuration, an enhanced ice and water shield product 40 (FIG. 6) can be manufactured. This configuration includes the use of both rubberized asphalt and recycled asphalt, where substantially between forty and eighty percent (40%–80%) and preferably sixty-six percent (66%) of the asphaltic material used in the ice and water shield is recycled asphalt material prepared as explained above from the combination of reclaimed roofing materials and flux asphalt.

Figure 6:
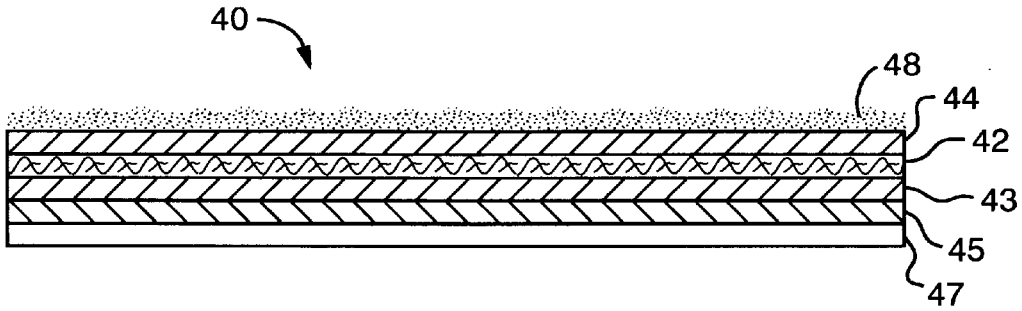
FIG. 6 shows a cross sectional view of an improved ice and water shield product using recycled asphalt materials in accordance with the teachings of the present invention.

FIG. 6 shows a cross section one embodiment of an ice and water shield product 40 made using recycled asphalt materials. The product begins with a fiberglass mat 42, which, as is the case with prior art ice and water shield products, acts as the product's backbone. However, instead of impregnating the mat with rubberized asphalt, the mat is impregnated with recycled asphalt material, which forms an inner and outer layer of recycled asphalt material 43 and 44, respectively. Next, the inner layer of the recycled asphalt material 43 is coated with a layer of standard rubberized asphalt 45 to achieve the desired adhesive characteristics of the ice and water shield in the area that contacts the roof deck. A release sheet 47 is also applied, which, like prior art ice and water shields, is removed when the ice and water shield is applied to a roof deck. Granules 48 are applied to the outer layer of recycled asphalt 44.

However, since the top or outer surface of the ice and water shield does not need to exhibit the same adhesive characteristics, less costly recycled asphalt can be applied to the outer surface. Then, granules are applied on top of the outer surface.

This construction offers significant advantages over prior art ice and water shields. First, is a significant cost advantage, which is realized by using less costly recycled asphalt materials in place of more costly rubberized asphalt material where the benefits of the rubberized asphalt material are not required. Furthermore, by using recycled asphalt materials, which include shredded fibers and mineral particles, the middle and/or outer layers of the ice and water shield will be more rigid.

Since roofers typically walk on top of these materials after they are applied to a sloped roof, the use recycled asphalt on the outer layer results in a greater level of personnel safety. First, in hot weather conditions, prior art ice and water shields can exhibit the extrusion of the rubberized asphalt through the granules applied to the outer surface. This would then stick to roofers' shoes, which would make walking more cumbersome. Also, prior art ice and water shields exhibit a significant amount of "give" under foot pressure due to the use of the soft, rubberized asphalt. This creates a slipping hazard. On the other hand, by using more rigid, recycled asphalt materials, the improved ice and water shield will be less likely to allow rubberized asphalt to penetrate to the outer surface of the shield and will be more rigid, and hence more slip resistant.

Figure 7:
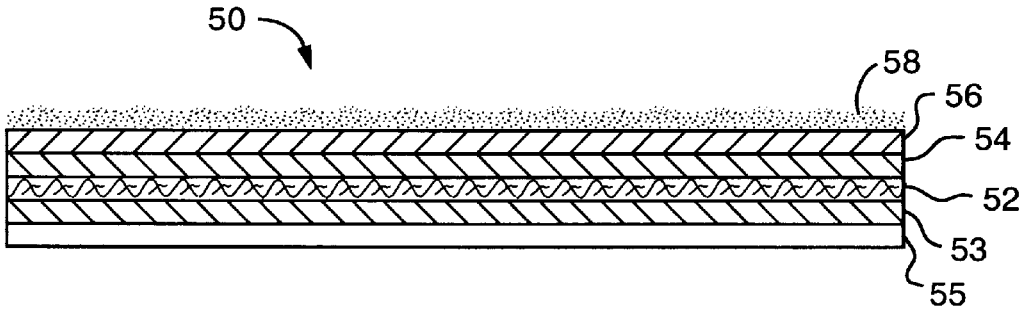
FIG. 7 shows a cross sectional view of an alternative embodiment of an improved ice and water shield product using recycled asphalt materials in accordance with the teachings of the present invention.

In an alternative embodiment (FIG. 7) an ice and water shield product 50 can be manufactured by impregnating a fiberglass mat backbone 52 with rubberized asphalt to form inner and outer layers of adhesive, rubberized asphalt 53 and 54, respectively. Then, a layer of recycled asphalt 56 can be applied to the outer layer of rubberized asphalt 54. Granules 58 can be applied to the layer of recycled asphalt and a release sheet 55 can be applied to the inner layer of rubberized asphalt 53. While this embodiment will provide an improvement over the prior art, it will be more costly to manufacture than the embodiment discussed earlier with respect to FIG. 6.

Modifications and substitutions by one of ordinary skill in the art are considered to be within the scope of the present invention which is not to be limited except by the claims which follow.

What is claimed is:

1. A method of manufacturing roofing materials comprising the steps of:

processing waste asphalt-based roofing materials to produce reclaimed roofing material;

reconstituting said reclaimed roofing material into a recycled asphalt material by mixing substantially between 20 percent and 50 percent by weight flux asphalt with substantially between 50 percent and 80 percent by weight reclaimed roofing materials; and saturating within and coating first and second sides of a roofing material backbone with inner and outer layers of said recycled asphalt material.

2. The method of manufacturing roofing materials as claimed in claim 1 further comprising the step of coating said inner and outer layers of recycled asphalt material with inner and outer layers comprising oxidized asphalt material to encapsulate said recycled asphalt material layers.

3. The method of manufacturing roofing materials as claimed in claim 1 further comprising the step of applying granules upon said outer layer of recycled asphalt material.

4. The meth of manufacturing roofing materials as claimed in claim 2 further comprising the step of applying granules upon said outer layer of said oxidized asphalt material.

5. The method of claim 1 further including the step of coating said inner layer of recycled asphalt material with a layer of rubberized asphalt material.

6. The method of claim 5 further including applying a release sheet to said layer of rubberized asphalt.

7. The method of claim 5 further including applying granules to said outer layer of recycled asphalt material.

8. The method of claim 1 wherein said reclaimed roofing materials include cellulose fiber.

9. The method of claim 8 wherein said reclaimed roofing materials include fiberglass fibers.

10. The method of claim 8 wherein said reclaimed roofing materials include between about 5 and 20 percent by weight fiber material.

11. The method of claim 1 wherein said flux asphalt has a melting point of approximately 100° F., and wherein said recycled asphalt material has a melting point generally higher than 100° F.

12. A method of manufacturing roofing materials comprising the steps of:

mixing reclaimed roofing material including at least cellulose fibers with non-oxidized asphalt to obtain a recycled asphalt material having a higher melting point than said non-oxidized asphalt;

saturating within and coating first and second sides of a roofing material backbone with inner and outer layers of said recycled asphalt material; and coating said inner and outer layers of said recycled asphalt material with inner and outer layers of an oxidized asphalt material to encapsulate said recycled asphalt material.

13. The method of claim 12 wherein said non-oxidized asphalt includes flux asphalt.

14. The method of claim 13 wherein said flux asphalt has a melting point of approximately 100° F., and wherein said recycled asphalt material has a melting point generally higher than 100° F.

15. The method of claim 13 wherein said recycled asphalt material includes substantially between 20 percent and 50 percent by weight flux asphalt and substantially between 50 percent and 80 percent by weight reclaimed roofing materials.

16. A method of manufacturing roofing materials comprising the steps of:

mixing flux asphalt with reclaimed roofing material including at least cellulose fibers, to create a recycled asphalt material having a higher melting point than said non-oxidized asphalt; and saturating within and coating first and second sides of a roofing material backbone with inner and outer layers of said recycled asphalt material.

17. The method of claim 16 wherein said recycled asphalt material includes substantially between 20 percent and 50 percent by weight flux asphalt and substantially between 50 percent and 80 percent by weight reclaimed roofing materials.

18. The method of claim 16 further including the step of coating said inner layer of recycled asphalt material with a layer of rubberized asphalt material.

19. The method of claim 16 further including the step of coating said inner and outer layers of recycled asphalt material with layers of oxidized asphalt material to encapsulate said recycled asphalt material.

20. The method of claim 16 wherein said flux asphalt has a melting point of approximately 100° F., and wherein said recycled asphalt material has a melting point generally higher than 100° F.

* * * * *